US006871925B2

(12) United States Patent
Yamamoto et al.

(10) Patent No.: US 6,871,925 B2
(45) Date of Patent: Mar. 29, 2005

(54) INKJET PRINTING APPARATUS, CONTROL METHOD THEREFOR, AND PROGRAM

(75) Inventors: Tadashi Yamamoto, Kanagawa (JP); Takaaki Hoshino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/412,288

(22) Filed: Apr. 14, 2003

(65) Prior Publication Data

US 2004/0021712 A1 Feb. 5, 2004

(30) Foreign Application Priority Data

Apr. 18, 2002 (JP) ..... 2002-116310

(51) Int. Cl.[7] ..... B41J 29/38; B41J 29/393
(52) U.S. Cl. ..... 347/6; 347/19
(58) Field of Search ..... 347/6, 7, 14, 19

(56) References Cited

U.S. PATENT DOCUMENTS

| | | | | |
|---|---|---|---|---|
| 4,196,625 A | * | 4/1980 | Kern | 73/304 R |
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,723,129 A | | 2/1988 | Endo et al. | 346/1.1 |
| 4,740,796 A | | 4/1988 | Endo et al. | 346/1.1 |
| 6,209,980 B1 | | 4/2001 | Kobayashi et al. | 347/7 |
| 6,685,295 B2 | * | 2/2004 | Roman et al. | 347/19 |
| 2004/0021711 A1 | * | 2/2004 | Hasseler et al. | 347/7 |

FOREIGN PATENT DOCUMENTS

| | | | |
|---|---|---|---|
| EP | 666178 | 9/1995 | B41J/2/175 |
| JP | 2001-71585 | 3/2001 | |
| JP | 2002-19137 | 1/2002 | |

* cited by examiner

*Primary Examiner*—Stephen D. Meier
*Assistant Examiner*—Alfred Dudding
(74) *Attorney, Agent, or Firm*—Fitzpatrick, Cella, Harper & Scinto

(57) ABSTRACT

In an inkjet printing apparatus which holds a printhead for performing printing by using ink supplied from an ink tank via an ink supply channel, the ink tank has a tank-side terminal for detecting the presence state of ink in the ink tank. The printhead has a head-side terminal for detecting the presence state of ink in the printhead. The printing apparatus detects at least one of the presence state of ink in the ink tank, printhead, and ink supply channel by selecting a terminal used for detection between the tank-side terminal and the head-side terminal.

17 Claims, 11 Drawing Sheets

INKJET PRINTING APPARATUS, CONTROL METHOD THEREFOR, AND PROGRAM

FIELD OF THE INVENTION

The present invention relates to an inkjet printing apparatus which comprises a printhead for performing printing using ink supplied from an ink tank via an ink supply channel, a control method therefor, and a program.

BACKGROUND OF THE INVENTION

Of printing methods for a printer and the like, an inkjet printing method of discharging ink from an orifice (nozzle) to perform printing on a printing medium such as a printing sheet has widely been adopted in recent years because of a low-noise nonimpact printing method and high-density, high-speed printing operation.

A general inkjet printing apparatus comprises a driving means for driving a carrier holding an inkjet head, a convey means for conveying a printing sheet, and a control means for controlling these means. In order to generate energy for discharging ink from the nozzle of the inkjet head, some inkjet printing apparatuses pressurize ink by using an electromechanical transducer such as a piezoelectric element. Some apparatuses generate heat by emitting electromagnetic waves from a laser or the like. Some apparatuses bubble ink by heat generation. Some apparatuses bubble ink by heating a liquid by an electrothermal transducer having a heating resistor.

Of these apparatuses, an inkjet printing apparatus which discharges ink droplets by using heat energy can achieve high-resolution printing because nozzles can be arrayed at a high density. Especially, an inkjet head using an electrothermal transducer as an energy generation element can be easily downsized. Full use of this advantage can be made by applying an IC technique and microprocessing technique which have remarkably advanced and improved their reliability in the recent semiconductor manufacturing field. This facilitates high-density packaging and reduces the manufacturing cost.

In some supply means for supplying ink to an inkjet head, an inkjet head unit incorporates an ink tank having an absorber which holds ink. The ink tank is mounted on a carriage unit together with the inkjet head unit, and replaced together with the inkjet head unit.

According to another method, the ink tank and inkjet head of an inkjet head unit can be separated, and only the ink tank is replaced. If a large amount of ink is needed, the ink tank is fixed to an inkjet printing apparatus and supplies ink to the carriage unit via a flexible tube. This method is disclosed in, e.g., Japanese Patent Laid-Open Nos. 2001-71585 and 2002-19137.

Such an inkjet head comprises many nozzles and realizes high-speed printing by using these nozzles. However, a nozzle is clogged with dust contained in ink during printing and cannot discharge ink. A fiber of paper as a printing medium may enter a nozzle, failing to discharge ink.

In an inkjet method of boiling ink by a heater in a nozzle and discharging ink, the heater may degrade and fail to discharge ink upon many printing operations. For these reasons, the inkjet head is generally shorter in service life than other building components of the inkjet printing apparatus. A general inkjet head is therefore designed to be replaceable.

If the inkjet printing apparatus has a mechanism which allows the operator to replace an inkjet head while the apparatus is OFF or is ON but idle without any printing, a hollow needle for supplying ink to the ink chamber of the inkjet head communicates with outside air when the operator dismounts the inkjet head. Ink in the supply tube serving as an ink supply channel which connects the ink tank and inkjet head returns toward the ink tank.

Further, ink flows from the hollow needle of the ink tank serving as the connection point of the supply tube toward the air communication tube of the ink tank. As a result, the ink level in the air communication tube and the ink level in the supply tube become flush with each other and hold an equilibrium state.

After that, the operator mounts a new inkjet head. At this time, the supply tube is not filled with ink.

When an inkjet head is replaced or dismounted, the operator must turn on the inkjet printing apparatus and manually execute ink supply operation to the inkjet head. This is because the inkjet printing apparatus cannot recognize replacement or dismounting of the inkjet head in the power OFF state of the inkjet printing apparatus.

When the operator can mechanically dismount an inkjet head while the printing apparatus is ON but idle without any printing, power supply to the inkjet head stops, and various control signals to the inkjet head are disabled in order to prevent damage to the inkjet head by dismounting. Even if the inkjet printing apparatus is ON, the inkjet printing apparatus cannot recognize replacement or dismounting of the inkjet head.

If the operator does not manually perform the above-mentioned ink supply operation and the inkjet head is new, no ink exists in the ink chamber of the inkjet head. Only recovery operation of the inkjet head before printing operation cannot satisfactorily fill the ink chamber of the inkjet head with ink, generating a printing error.

When the inkjet head is not new but is dismounted, printing can start with ink left in the ink chamber of the inkjet head. However, air in the supply tube enters the ink chamber of the inkjet head, and the ink surface in the ink chamber of the inkjet head lowers, generating a printing error.

In general, to prevent generation of any printing error, the inkjet printing apparatus has a head replacement mode in which the inkjet head cannot be mechanically dismounted while the printing apparatus is OFF or is ON but idle without any printing, and can be replaced only by operation via an operation panel or the like by the operator. In this case, in response to operation to the head replacement mode, the inkjet printing apparatus moves the inkjet head to a position where the inkjet head can be replaced, or releases a mechanism which inhibits dismounting.

When the operator cancels the head replacement mode, the inkjet printing apparatus returns the inkjet head to an original position or resets the mechanism which inhibits dismounting the inkjet head. In response to cancellation of the head replacement mode, the inkjet printing apparatus interprets that the inkjet head is replaced or dismounted, and automatically executes ink supply operation and recovery operation. This method can avoid generation of the above-described printing error.

However, this method increases the cost of the mechanism which inhibits dismounting the inkjet head. In addition, the inkjet head cannot be replaced unless the apparatus is ON. Even if the operator does not actually dismount the inkjet head in the head replacement mode, ink supply operation and recovery operation are executed, wastefully consuming ink.

As another method of preventing any error, the presence of ink in the supply tube is detected to prevent entrance of air in the supply tube into the ink chamber of the inkjet head or control ink supply operation and recovery operation.

In this method, however, only the presence of ink in the supply tube is detected, and the detection precision is not increased by considering the presence of ink in the ink tank serving as a building component of the ink supply mechanism or ink in the ink chamber of the inkjet head. Ink supply operation and recovery operation complying with the detection result may be wastefully controlled.

SUMMARY OF THE INVENTION

The present invention has been made to overcome the conventional drawbacks, and has as its object to provide an inkjet printing apparatus which can easily detect at a high precision the presence state of ink in an ink supply channel between an inkjet head and an ink tank, in the ink tank, and in the inkjet head, a control method therefore, and a program.

According to the present invention, the foregoing object is attained by providing an inkjet printing apparatus which holds a printhead for performing printing by using ink supplied from an ink tank via an ink supply channel, comprising: the ink tank has a tank-side terminal for detecting presence state of ink in the ink tank, the printhead has a head-side terminal for detecting the presence state of ink in the printhead, and the printing apparatus comprises detection means for detecting at least one of the presence state of ink in the ink tank, the printhead, and the ink supply channel by selecting a terminal used for detection between the tank-side terminal and the head-side terminal.

In a preferred embodiment, wherein the detection means detects the presence state of ink in any combination between the ink tank, the printhead, and the ink supply channel by switching a terminal to be selected.

In a preferred embodiment, a detection time for detecting the presence state of ink in the ink supply channel is set longer than a detection time for detecting the presence state of ink in the ink tank and the printhead.

In a preferred embodiment, the ink tank has at least two, first and second tank-side terminals, the printhead has at least two, first and second head-side terminals, the first tank-side terminal functions as an air communication terminal, the ink supply channel is connected between the second tank-side terminal and the second head-side terminal, and the detection means switches and executes detection of the presence state of ink in the ink tank by using the first and second tank-side terminals, detection of the presence state of ink in the printhead by using the first and second head-side terminals, and detection of the presence state of ink in the ink supply channel by using the second tank-side terminal and the second head-side terminal.

In a preferred embodiment, the detection means comprises voltage application means for applying voltages between the first and second tank-side terminals, between the first and second head-side terminals, and between the second tank-side terminal and the second head-side terminal, current detection means for detecting currents flowing between the first and second tank-side terminals, between the first and second head-side terminals, and between the second tank-side terminal and the second head-side terminal, and switching means for switching voltage directions between the first and second tank-side terminals, between the first and second head-side terminals, and between the second tank-side terminal and the second head-side terminal.

In a preferred embodiment, the detection means executes switching operation by the switching means every predetermined period.

According to the present invention, the foregoing object is attained by providing an inkjet printing apparatus which holds a printhead for performing printing by using ink supplied from an ink tank via an ink supply channel, comprising: current supply means for supplying a current to the ink supply channel by using a terminal attached to the printhead; and a detection circuit which detects presence state of ink in the ink supply channel by detecting an intermediate potential between a resistance concerning a state of ink in the ink supply channel and a voltage-dividing resistance series-connected to the resistance, wherein the terminal attached to the printhead is electrically connected to a low-ground-impedance side of the detection circuit.

In a preferred embodiment, the terminal also serves as a communication member for making ink and air flow.

According to the present invention, the foregoing object is attained by providing a method of controlling an inkjet printing apparatus which holds a printhead for performing printing by using ink supplied from an ink tank via an ink supply channel, comprising: a detection step of detecting at least one of presence state of ink in the ink tank, the printhead, and the ink supply channel by selecting a terminal used for detection between terminals which are attached to the ink tank and the printhead and detect the presence state of ink in the ink tank and the printhead; and a control step of controlling detection in the detection step.

According to the present invention, the foregoing object is attained by providing a method of controlling an inkjet printing apparatus which holds a printhead for performing printing by using ink supplied from an ink tank via an ink supply channel, comprising: a current supply step of supplying a current to the ink supply channel by using a terminal attached to the printhead; and a control step of controlling a detection circuit which detects presence state of ink in the ink supply channel by detecting an intermediate potential between a resistance concerning a state of ink in the ink supply channel and a voltage-dividing resistance series-connected to the resistance, wherein the terminal attached to the printhead is electrically connected to a low-ground-impedance side of the detection circuit.

According to the present invention, the foregoing object is attained by providing a program which causes a computer to control an inkjet printing apparatus which holds a printhead for performing printing by using ink supplied from an ink tank via an ink supply channel, comprising: a program code for a detection step of detecting at least one of presence state of ink in the ink tank, the printhead, and the ink supply channel by selecting a terminal used for detection between terminals which are attached to the ink tank and the printhead and detect the presence state of ink in the ink tank and the printhead; and a program code for a control step of controlling detection in the detection step.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Preferred embodiments of the present invention will be described in detail below with reference to the accompanying drawings.

(First Embodiment)

Figure 1:
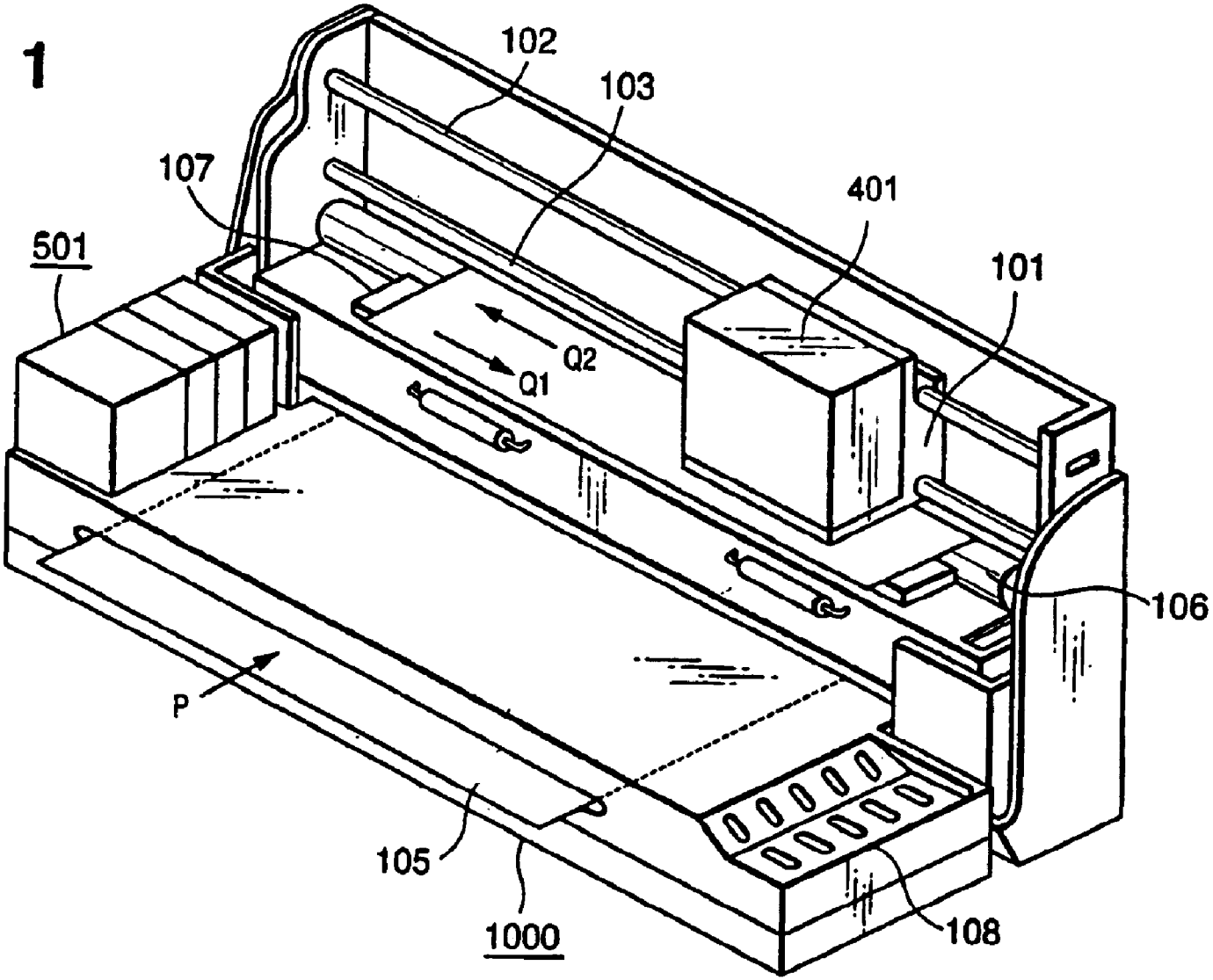
FIG. 1 is a perspective view showing the schematic arrangement of an inkjet printing apparatus to which the present invention can be applied.

FIG. 1 is a perspective view showing the schematic arrangement of an inkjet printing apparatus to which the present invention can be applied.

The inkjet printing apparatus (to be referred to as a printing apparatus) can perform both color printing and monochrome printing. For a monochrome printing apparatus, the printhead is equipped with only nozzles for discharging black ink (to be described later).

A printing medium 105 inserted into the sheet feed position of a printing apparatus 1000 is fed by a feed roller 106 in a direction indicated by an arrow P, and conveyed to the printable region of a printhead 401. A platen 107 is arranged below the printing medium 105 in the printable region. A carriage 101 can be moved by two guide shafts 102 and 103 along them. The carriage 101 is reciprocally scanned by driving of a DC motor (not shown) within a scanning region including a printing region in directions indicated by arrows Q1 and Q2 serving as a main scanning direction. After one main scanning ends, the printing medium is fed by a predetermined amount in the sub-scanning direction indicated by the arrow P, and waits for the next main scanning. Main scanning and sub-scanning are repeated to perform printing operation of one page.

In FIG. 1, the printhead 401 having orifices (printing elements) capable of discharging ink is mounted on the carriage 101. The printhead 401 is mounted on the carriage 101 such that printing is done by discharging ink from the orifice of the printhead 401 to the printing medium 105 below it. Ink is supplied from an ink tank 501 to the printhead 401 via a supply tube.

Reference numeral 108 denotes an operation panel including switches and a display. The switches are used to power on/off the printing apparatus 1000 or set various printing modes. The display can display various statuses of the printing apparatus 1000.

The printhead 401 can print data in four colors: yellow (Y), magenta (M), cyan (C), and black (Bk). The number of orifices for each of Y, M, and C is 128, and the number of orifices for Bk is 320. The layout pitch between orifices for each color is 1/600 inch in the sub-scanning direction, which corresponds to about 42 $\mu$m. The printhead 401 can perform printing operation at a density of 600 dpi in the main scanning direction.

A linear encoder (not shown) with a slit at a cycle of 600 dpi is arranged on the back side of the carriage 101. A mechanical controller 1404 (FIG. 3) operates the carriage motor of a mechanical unit 1405, reciprocating the carriage 101 in the main scanning direction (directions indicated by Q1 and Q2 in FIG. 1).

The carriage motor which drives the carriage 101 is, e.g., a DC motor. In general printing operation, the position or moving speed of the carriage 101 is detected by an optical sensor on the back side of the carriage 101 by using the linear encoder. The scanning speed of the carriage 101 is kept constant under DC servo control.

The orifice layout of the printhead 401 will be explained with reference to FIG. 2.

Figure 2:
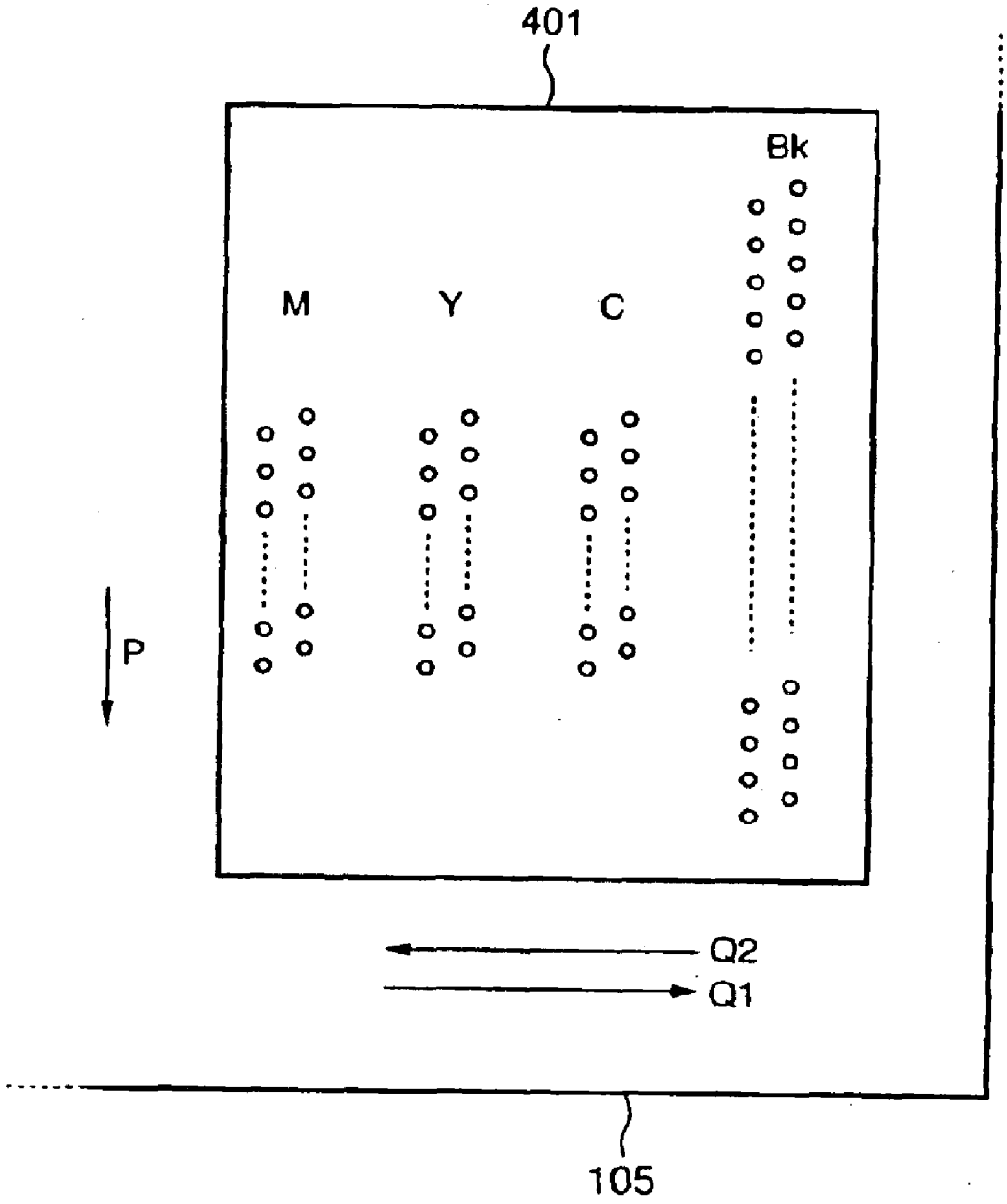
FIG. 2 is a view showing the orifice layout of a printhead to which the present invention can be applied.

FIG. 2 is a view showing the orifice layout of the printhead to which the present invention can be applied.

As described above, the printhead 401 has orifices for discharging a plurality of color inks in yellow (Y), magenta (M), cyan (C), and black (K). In practice, orifices for each color are arrayed in two lines, and the layout pitch between the lines is 1/300 inch. The printhead 401 moves in the main scanning directions indicated by the arrows Q1 and Q2 with respect to the printing medium 105. The printing medium 105 is relatively moved in the direction indicated by the arrow P with respect to the printhead 401.

The main arrangement of a printing system comprised of the printing apparatus 1000 and a host apparatus 500 will be explained with reference to FIG. 3.

Figure 3:
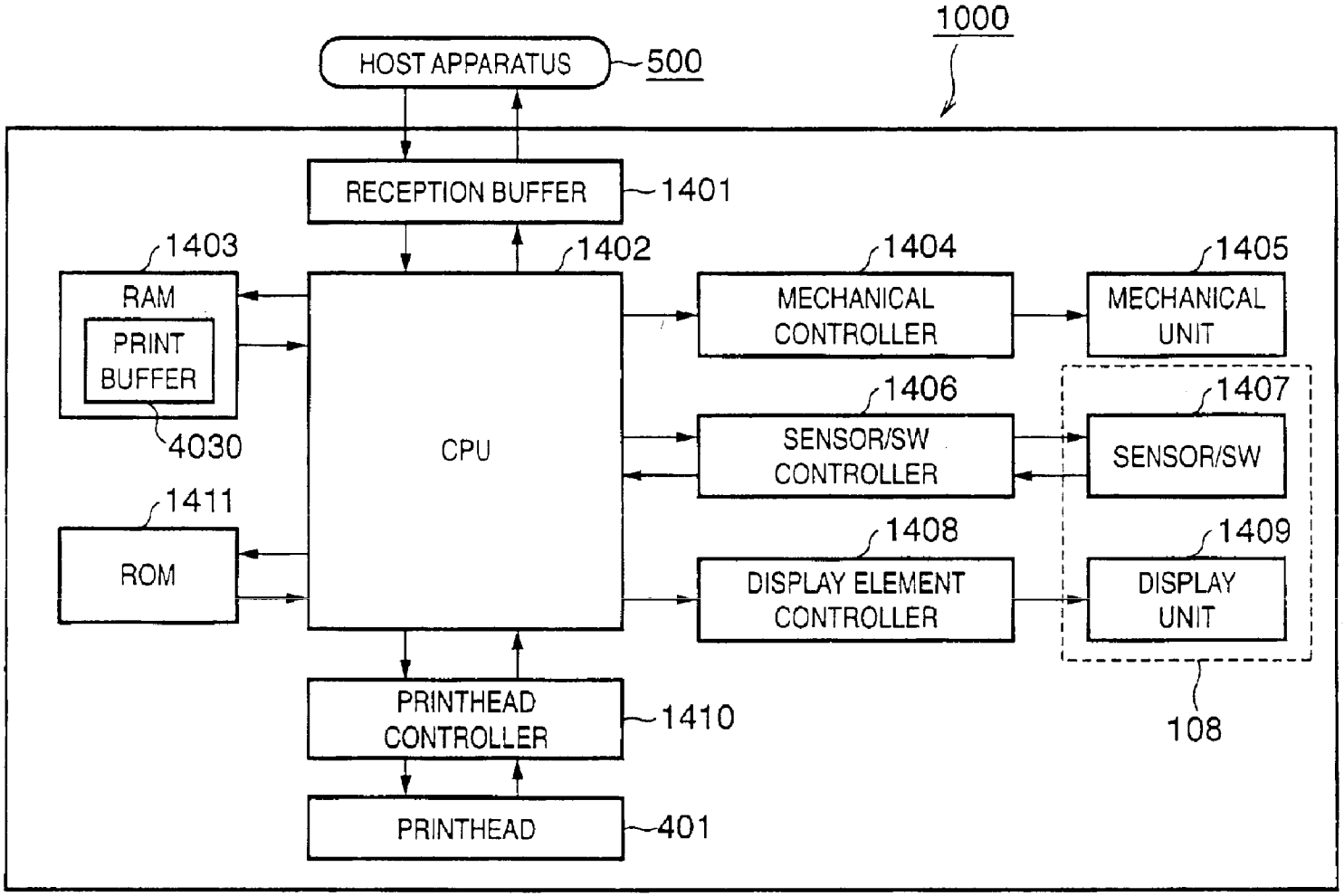
FIG. 3 is a block diagram showing the main arrangement of the inkjet printing apparatus to which the present invention can be applied.

FIG. 3 is a block diagram showing the main arrangement of the inkjet printing apparatus to which the present invention can be applied.

Print data (e.g., data containing character data, image data, and control data) is transmitted from the host apparatus 500 to the printing apparatus 1000, and stored in a reception buffer 1401. Verify data for verifying whether print data is correctly transferred, and status data representing the operation status of the printing apparatus 1000 are transmitted from the printing apparatus 1000 to the host apparatus 500.

Note that the host apparatus 500 and printing apparatus 1000 are connected by, e.g., a USB interface. However, the present invention is not limited to this, and can take any type of interface such as IEEE 1394, IEEE 1284 (Centronics), IrDA, or Bluetooth. Any interface can be adopted as long as the interface can transfer data by connecting the host apparatus 500 and printing apparatus 1000 by wire or wirelessly.

Print data stored in the reception buffer 1401 is processed into data for printing in main scanning of the printhead 401 under the control of a CPU 1402. The resultant data is stored in a print buffer 4030 within a random access memory (RAM) 1403. Data in the print buffer 4030 is transferred to the printhead 401 by a printhead controller 1410. The printhead 401 is controlled to print character data or image data. The printhead controller 1410 detects temperature information or the like representing the state of the printhead 401, and sends the information to the CPU 1402. The information is transmitted to the printhead controller 1410 which controls driving of the printhead 401.

The mechanical controller 1404 drives and controls the mechanical unit 1405 such as a carriage motor or line feed motor in response to an instruction from the CPU 1402.

A sensor/SW controller 1406 transmits a signal to the CPU 1402 from a sensor/SW 1407 including various sensors and SW (switch).

A display element controller 1408 controls a display unit 1409 comprised of LEDs, liquid crystal display elements, and the like for display panels in response to an instruction from the CPU 1402.

A ROM 1411 stores data such as various control programs and various setting data for executing various control operations of the printing apparatus 1000. The CPU 1402 appropriately loads various control programs and various setting data into the RAM 1403, and executes them, thereby executing various control operations of the printing apparatus 1000.

The host apparatus 500 is implemented by a general-purpose computer such as a personal computer or workstation. The host apparatus 500 has standard building components mounted in a general-purpose computer (e.g., a CPU, RAM, ROM, hard disk, external memory, network interface, display, keyboard, and mouse). The building components are not limited to them, and any building components can be adopted as long as they realize the present invention. The building components shown in FIG. 3 may be realized by executing by the CPU a program stored in the internal ROM of the host apparatus 500 or an external memory, or by dedicated hardware.

The arrangement of an ink supply mechanism including the printhead 401 and an ink tank for supplying ink to the printhead 401 will be explained with reference to FIG. 4.

Figure 4:
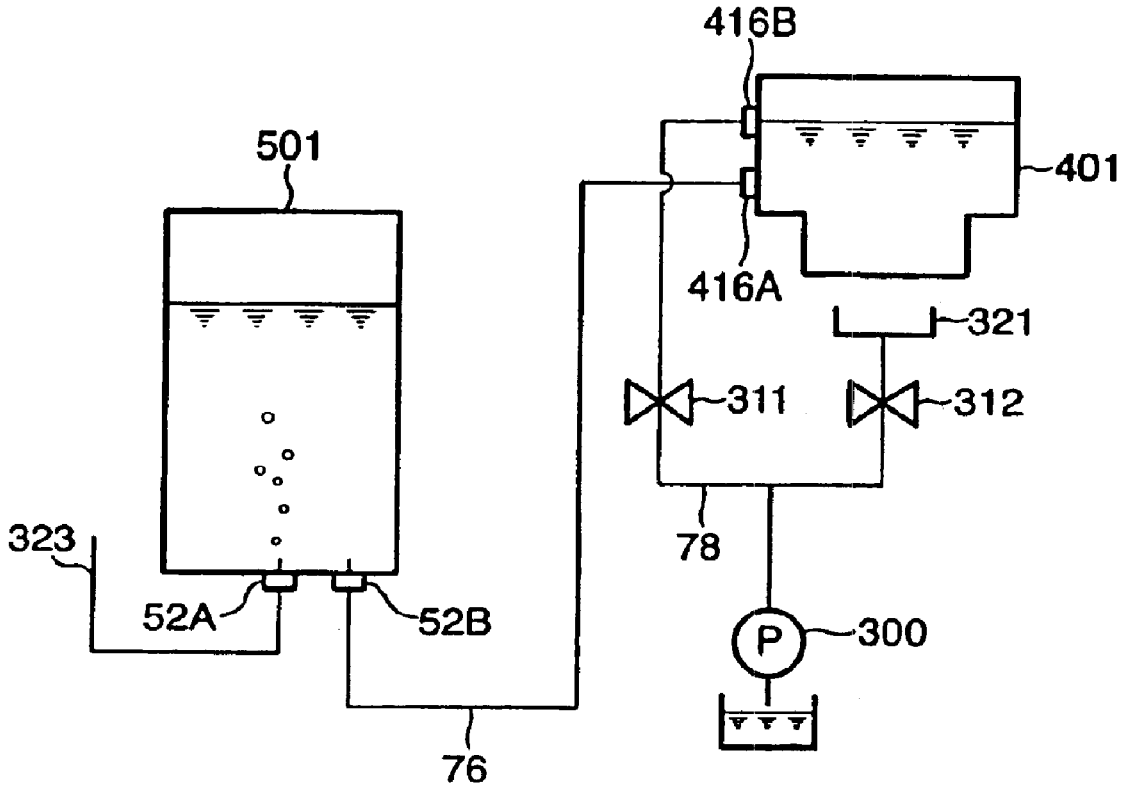
FIG. 4 is a view showing the arrangement of an ink supply mechanism according to the first embodiment.

FIG. 4 is a view showing the arrangement of the ink supply mechanism according to the first embodiment.

This apparatus is a color printing apparatus which performs color printing using a printhead having ink tanks which store yellow, magenta, cyan, and black inks. FIG. 4 shows an ink supply mechanism for one of these colors.

In FIG. 4, the ink tank 501 has a closed structure. Hollow needles 52A and 52B are vertically inserted at the bottom of the ink tank 501 into the ink chamber of the ink tank 501 via rubber packings. The hollow needle 52A is connected to an air communication tube 323, and communicates with air at the other end of the air communication tube 323. Reference numerals 416A and 416B are hollow needles which reach the ink chamber of the printhead 401 via rubber packings.

An ink discharge nozzle array is arranged vertically downward at the bottom of the printhead 401. Each nozzle in the nozzle array is filled with ink up to the nozzle orifice plane by the surface tension of ink. A cap 321 can vertically move, and when the printing apparatus 1000 does not perform printing, covers the nozzle array to prevent ink from drying. In the presence of a nozzle at which the nozzle meniscus is lost and ink does not reach the orifice plane, a supply valve 311 is closed while the cap 321 covers the nozzle array. A recovery valve 312 is then opened, and ink is sucked by a suction pump 300. Ink in the printhead 401 is sucked via the nozzle, recovering the nozzle meniscus.

The hollow needle 52B of the ink tank 501 is connected to a supply tube 76 (ink supply channel), and the other end of the supply tube 76 is connected to the lower hollow needle 416A of the printhead 401. The upper hollow needle 416B is connected to a suction tube 78, which reaches the supply valve 311 and suction pump 300. To supply ink to the ink chamber of the printhead 401, the recovery valve 312 is closed, the supply valve 311 is opened, and ink is sucked by the suction pump 300. Air at an upper portion in the ink chamber of the printhead 401 is exhausted via the hollow needle 416B, and the interior of the ink chamber becomes a negative pressure.

At the negative pressure, ink in the ink tank 501 is sucked from the hollow needle 416A via the supply tube 76, supplying ink to the printhead 401. When the ink surface in the ink chamber of the printhead 401 reaches the hollow needle 416B, ink is sucked from the hollow needle 416B. At this time, suction operation is completed. The supply tube 76 is filled with ink from the hollow needle 52B of the ink tank 501 to the hollow needle 416A of the printhead 401.

The level of the nozzle orifice of the printhead 401 is set higher than the level of the distal end of the hollow needle 52A of the ink tank 501 in the ink chamber of the tank. Hence, the pressure in the ink chamber of the printhead 401 is negative with respect to outside air. The pressure in the ink chamber of the printhead 401 is negative, but ink in the nozzle of the printhead 401 reaches the orifice plane against the negative pressure because of the surface tension. If inkjet printing is performed in this state, ink in the nozzle is discharged, and the ink surface in the nozzle retracts (upward in this example) from the orifice plane. However, the ink surface returns to the orifice plane owing to the surface tension. By repeating this, the printing apparatus 1000 performs stable printing.

When the printing apparatus 1000 is OFF or kept idle without any printing even in the power ON state, ink is filled in the supply tube 76 from the hollow needle 52B of the tank to the hollow needle 416A of the printhead 401. The pressure in the ink chamber of the printhead 401 is negative. While ink in the nozzle of the printhead 401 reaches the orifice plane against the negative pressure because of the surface tension, the cap 321 covers the nozzle orifice.

Ink is generally electrolytic and conductive. The hollow needles 52A and 52B serving as communication members which are attached to the ink tank 501 and make ink and gas flow inside and outside the ink tank 501 are made of a conductive member and generally use a metal. In the first embodiment, the printing apparatus 1000 comprises the first voltage application means for applying a voltage between the hollow needles 52A and 52B. The printing apparatus 1000 also comprises the first detection means for detecting a current flowing through ink upon application of a voltage. That is, the hollow needles 52A and 52B serving as communication members are used as current detection terminals.

The first voltage application means comprises the first switching means for switching the voltage direction between the hollow needles 52A and 52B. When ink exists in the ink tank 501, ink exists between the hollow needles 52A and 52B, and a current flows between them. In the absence of ink, no current flows. By detecting the presence/absence of a current, whether ink in the ink tank 501 decreases to a predetermined amount or less can be detected to generate a warning which prompts the operator to replace the ink tank. In addition, the average current charge amount is decreased to almost 0 by the first switching means, which can prevent corrosion of the hollow needles 52A and 52B serving as electrodes.

The hollow needles 416A and 416B serving as communication members which are attached to the printhead 401 and make ink and gas flow inside and outside the ink chamber are made of a conductive member and generally use a metal. In the first embodiment, the printing apparatus 1000 comprises the second voltage application means for applying a voltage between the hollow needles 416A and 416B. The printing apparatus 1000 also comprises the second detection means for detecting a current flowing through ink upon application of a voltage. That is, the hollow needles 416A and 416B serving as communication members are used as current detection terminals.

The second voltage application means comprises the second switching means for switching the voltage direction between the hollow needles 416A and 416B. When the ink surface in the printhead 401 reaches the hollow needle 416B, a current flows between the hollow needles 416A and 416B. In the absence of ink, no current flows. By detecting the presence/absence of a current, whether ink in the printhead 401 reaches to a predetermined amount can detected. After the detection, ink suction operation to the ink chamber of the printhead 401 ends. In addition, the average current charge amount is decreased to almost 0 by the second switching means, which can prevents corrosion of the hollow needles 416A and 416B serving as electrodes.

The printing apparatus 1000 comprises the third voltage application means for applying a voltage between the hollow needle 52B of the ink tank 501 and the hollow needle 416A of the printhead 401. The printing apparatus 1000 also comprises the third detection means for detecting a current flowing through ink in the supply tube 76 between the printhead 401 and the ink tank 501 upon application of a voltage.

The third voltage application means comprises the third switching means for switching the voltage direction between the hollow needles 52B and 416A. When the supply tube 76 is filled with ink, a current flows between the hollow needles 52B and 416A. If air enters the supply tube 76, no current flows. By detecting the presence/absence of a current flowing through the supply tube 76, the state (presence of bubbles or absence of ink) of the supply tube 76 between the printhead 401 and the ink tank 501 can be detected.

Particularly in the first embodiment, the printing apparatus 1000 detects a current between the hollow needles 52B and 416A by the third detection means before printing operation. If no current is detected, ink suction operation to the ink chamber of the printhead 401 is executed. That is, only in the presence of bubbles in the supply tube 76 or the absence of ink, ink suction operation to the ink chamber of the printhead 401 is executed. Since ink suction operation to the ink chamber of the printhead 401 can be executed only in the need for ink suction operation, printing can be stabilized and wasteful ink consumption can be prevented.

By decreasing the average current charge amount to almost 0 by the third switching means, corrosion of the hollow needles 52B and 416A serving as electrodes can be prevented.

Figure 5:
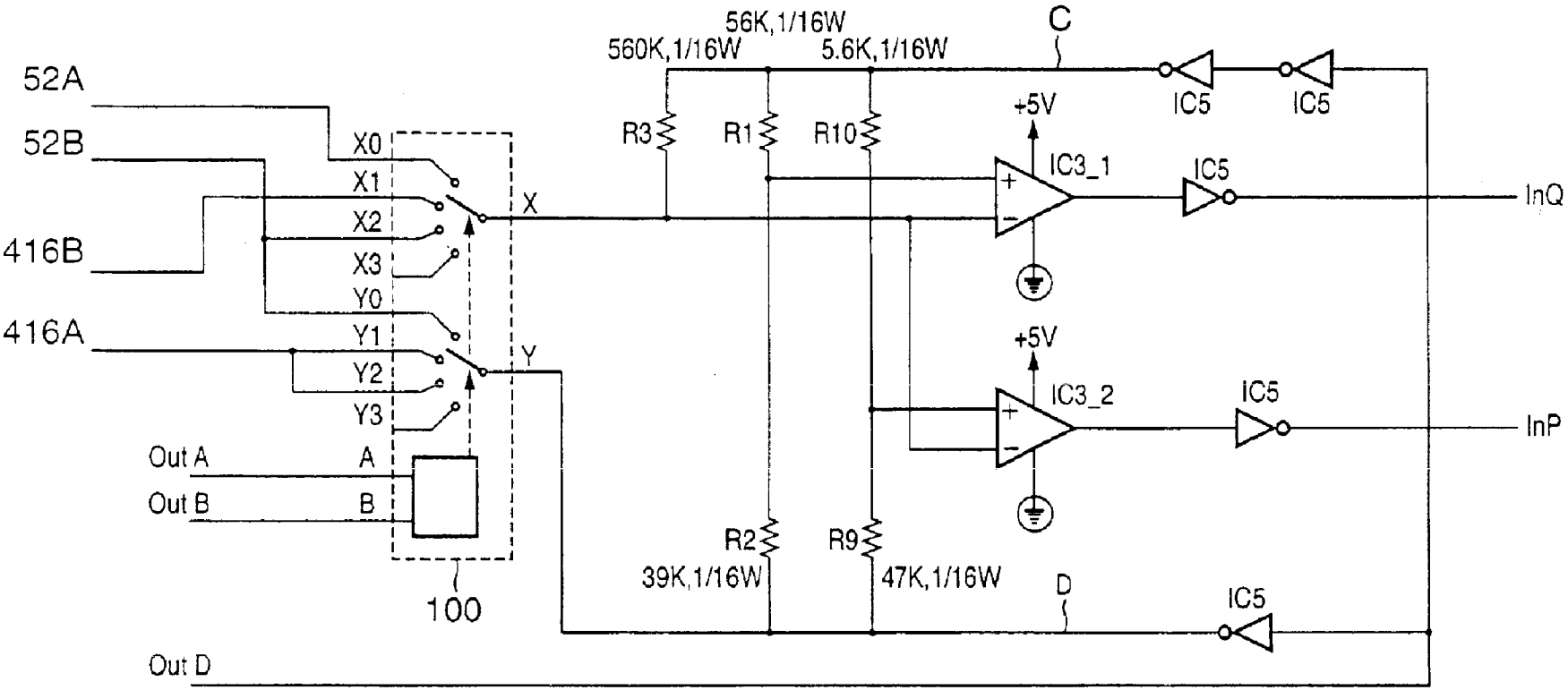
FIG. 5 is a circuit diagram showing the arrangement of the ink detection circuit of an ink supply mechanism according to the first embodiment.

An example of an ink detection function (ink detection circuit) which detects at least one of the presence state of ink in the printhead 401, the ink tank 501, and the supply tube 76 between the printhead 401 and the ink tank 501 by using an arrangement in which the ink supply mechanism incorporates the first to third voltage application means for applying a voltage between hollow needles, the first to third detection means for detecting a current, and the first to third switching means for switching the voltage application direction will be described with reference to FIG. 5.

FIG. 5 is a circuit diagram showing the arrangement of the ink detection circuit of the ink supply mechanism according to the first embodiment.

Signals 52A, 52B, 416A, and 416B are electrically connected to corresponding hollow needles in FIG. 4. Signals OutA, OutB, and OutD are output ports of the CPU 1402 (FIG. 3) which controls the printing apparatus 1000. Signals InQ and InP are input ports of the CPU 1402. Reference numeral 100 denotes a rotary analog switch. The analog switch 100 connects a terminal X to any one of terminals X0, X1, X2, and X3 in accordance with signal values input from terminals A and B of 2 bits. Similarly, the analog switch 100 connects a terminal Y to any one of terminals Y0, Y1, Y2, and Y3. Reference symbols IC3_1 and IC3_2 are comparators; and IC5, an inverter.

Operation of detecting the presence state of ink in the ink tank 501 will be described.

The CPU 1402 controls the signals OutA and OutB to connect the terminal X of the analog switch 100 to the terminal X0 and the terminal Y to the terminal Y0. Accordingly, a bridge is formed between the impedance between the hollow needles 52A and 52B to be measured, and resistors R3, R1, and R2. The intermediate potential of the bridge is compared by the comparator IC3_1.

The output port signal OutD of the CPU 1402 is a control signal for switching the voltage application direction. For a high-level signal OutD, the potential at point C in FIG. 5 is high, i.e., 5 V, and the potential at point D is low, i.e., 0 V. For a low-level signal OutD, the potential at point C is 0 V, and the potential at point D is 5 V. Hence, the direction of a voltage applied between the hollow needles 52A and 52B is switched. In the first embodiment, the resistance value between the hollow needles 52A and 52B in the presence state of ink in the ink tank 501 is 20 kΩ to 30 kΩ. The resistance value in the absence of ink is 10 MΩ or more. For a high-level signal OutD in the absence of ink, an output from the comparator IC3_1 is low and the signal InQ is high. This relationship is reversed in the presence state of ink.

Detection operation of detecting the presence state of ink in the ink tank 501 will be explained with reference to FIG. 6.

Figure 6:
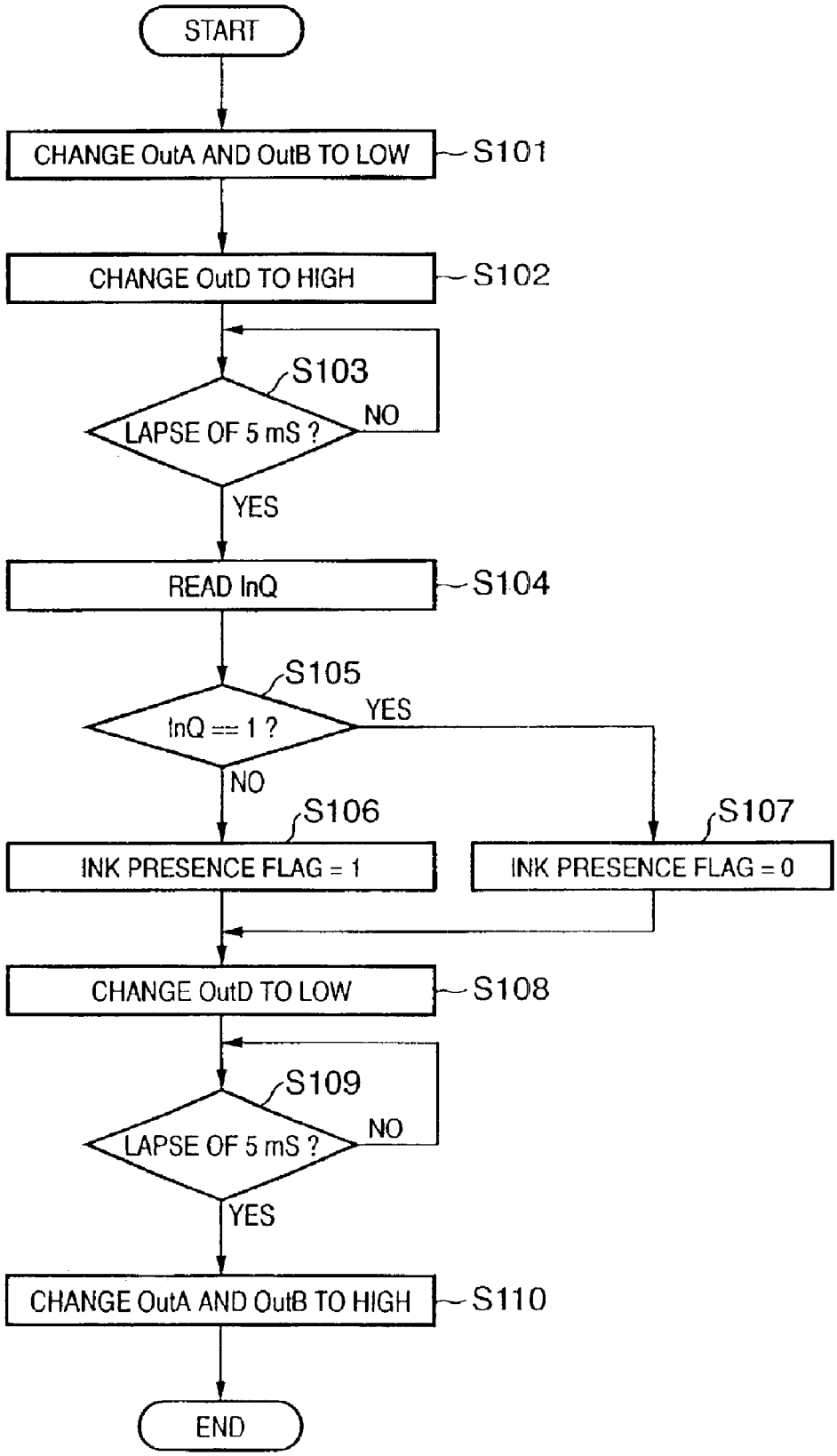
FIG. 6 is a flow chart showing detection operation of detecting the presence state of ink in an ink tank according to the first embodiment.

FIG. 6 is a flow chart showing detection operation of detecting the presence state of ink in the ink tank according to the first embodiment.

In step S101, the signals OutA and OutB are changed to low. The reason of changing the signals OutA and OutB to low immediately after the start is to connect the terminal X of the analog switch 100 to the terminal X0 and the terminal Y to the terminal Y0.

In step S102, the signal OutD is changed to high.

In step S103, the timer is driven to determine whether a period of 5 ms has been elapsed after the start. If the period of 5 ms has not been elapsed (NO in step S103), the processing waits for the lapse of 5 ms. If the period of 5 ms has been elapsed (YES in step S103), the processing advances to step S104.

In step S104, the value of the signal InQ is read. In step S105, whether the value of the signal InQ is 1 is determined. If the value is not 1 (NO in step S105), the processing advances to step S106 to determine that ink exists in the ink tank 501 and set an ink presence flag to 1. If the value is 1 (YES in step S105), the processing advances to step S107 to determine that no ink exists in the ink tank 501 and set the ink presence flag to 0.

Note that the ink presence flag is stored in, e.g., the RAM 1403.

In step S108, the signal OutD is changed to low. In step S109, the timer is driven to determine whether a period of 5 ms has been elapsed after the signal OutD is changed to low. If the period of 5 ms has not been elapsed (NO in step S109), the processing waits for the lapse of 5 ms. If the period of 5 ms has been elapsed (YES in step S109), the processing advances to step S110.

In step S110, the signals OutA and OutB are changed to high, and the processing ends. The reason of changing the signals OutA and OutB to high immediately before the end of processing is to connect the terminal X of the analog switch 100 to the terminal X3 and the terminal Y to the terminal Y3. That is, the terminals X and Y are disconnected from the hollow needles.

In FIG. 6, the signal OutD is switched every predetermined period (5 ms) in order to keep the average of current charges flowing between the hollow needles 52A and 52B at almost 0. The control program of the printing apparatus 1000 can display the presence/absence of ink in the ink tank 501 on the display unit 1409 of the operation panel 108 on the basis of the ink presence flag obtained by the above processing.

Detection operation of detecting whether the ink surface in the printhead 401 reaches the hollow needle 416B, i.e., detecting the ink level in the printhead 401 will be explained.

Whether the ink surface in the printhead 401 reaches the hollow needle 416B is detected as follows. The CPU 1402 controls the signals OutA and OutB to connect the terminal X of the analog switch 100 to the terminal X1 and the terminal Y to the terminal Y1. The same operation as detection operation in the presence state of ink in the ink tank 501 shown in FIG. 6 is executed to detect whether the ink level in the printhead 401 reaches the hollow needle 416B.

The processing flow of detection operation will be described with reference to FIG. 7.

Figure 7:
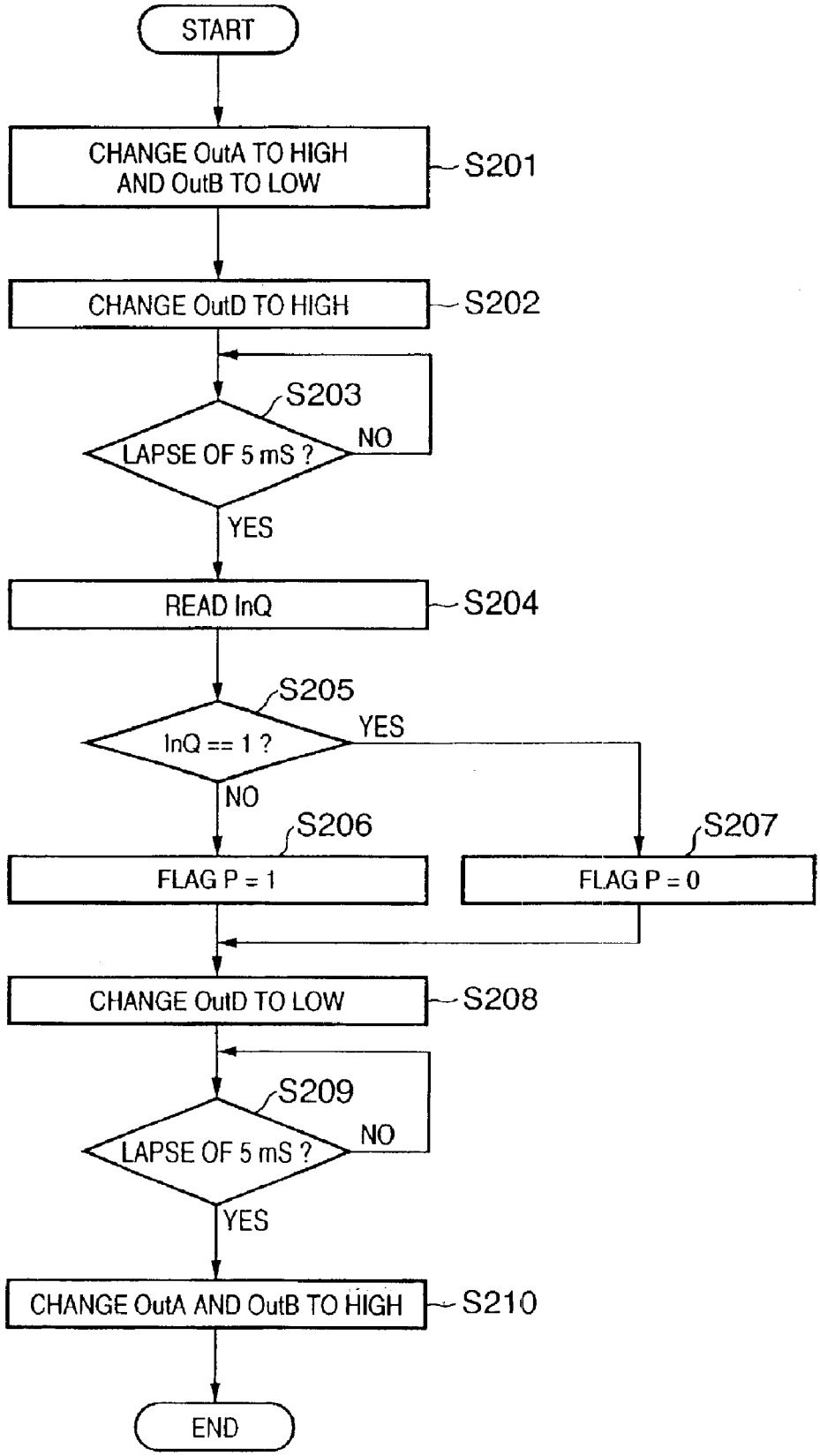
FIG. 7 is a flow chart showing detection operation of detecting the ink level in the printhead according to the first embodiment.

FIG. 7 is a flow chart showing detection operation of detecting the ink level in the printhead according to the first embodiment.

In step S201, the signals OutA and OutB are changed to high and low, respectively. The reason of changing the signals OutA and OutB to high and low immediately after the start is to connect the terminal X of the analog switch 100 to the terminal X1 and the terminal Y to the terminal Y1.

In step S202, the signal OutD is changed to high.

In step S203, the timer is driven to determine whether a period of 5 ms has been elapsed after the start. If the period of 5 ms has not been elapsed (NO in step S203), the processing waits for the lapse of 5 ms. If the period of 5 ms has been elapsed (YES in step S203), the processing advances to step S204.

In step S204, the value of the signal InQ is read. In step S205, whether the value of the signal InQ is 1 is determined. If the value is not 1 (NO in step S205), the processing advances to step S206 to determine that the ink surface reaches the hollow needle 416B and set a flag P representing this to 1. If the value is 1 (YES in step S205), the processing advances to step S207 to determine that the ink surface does not reach the hollow needle 416B and set the flag P to 0.

Note that the flag P is stored in, e.g., the RAM 1403.

In step S208, the signal OutD is changed to low. In step S209, the timer is driven to determine whether a period of 5 ms has been elapsed after the signal OutD is changed to low. If the period of 5 ms has not been elapsed (NO in step S209), the processing waits for the lapse of 5 ms. If the period of 5 ms has been elapsed (YES in step S209), the processing advances to step S210.

In step S210, the signals OutA and OutB are changed to high, and the processing ends. The reason of changing the signals OutA and OutB to high immediately before the end of processing is to connect the terminal X of the analog switch 100 to the terminal X3 and the terminal Y to the terminal Y3. That is, the terminals X and Y are disconnected from the hollow needles.

The flag P=1 obtained by this processing represents that the ink surface reaches the hollow needle 416B. For the flag P=0, the control program of the printing apparatus 1000 closes the recovery valve 312, opens the supply valve 311, and operates the suction pump 300, as ink suction operation to the printhead 401. While the suction pump 300 operates, the processing of FIG. 7 is periodically executed. When the flag P is set to 1, the suction pump 300 stops, the supply valve 311 is closed, and ink suction operation ends.

Detection operation of detecting whether ink is filled from the hollow needle 52B of the ink tank 501 to the hollow needle 416A of the printhead 401 via the supply tube 76 will be explained.

The CPU 1402 controls the signals OutA and OutB to connect the terminal X of the analog switch 100 to the terminal X2 and the terminal Y to the terminal Y2. As a result, a bridge is formed between the impedance between the hollow needles 52B and 416A to be measured, and the resistor R3, and resistors R10 and R9. The intermediate potential of the bridge is compared by the comparator IC3_1.

In the first embodiment, the resistance value between the hollow needles 52B and 416A when ink is filled from the hollow needle 52B of the ink tank 501 to the hollow needle 416A of the printhead 401 via the supply tube 76 is 2 MΩ to 3 MΩ. The resistance value in the absence of ink is 10 MΩ or more. This resistance value is a resistance via the supply tube 76 and is greatly different from a resistance value in detecting the presence state of ink in the ink tank 501 or detecting the ink level in the printhead 401.

In other words, the constant of the bridge circuit is desirably different from those in other cases. For a high-level signal OutD, the voltage divided by the resistors R10 and R9 is about 4.5 V, and a one-power-supply-type comparator (OP amplifier) used in the first embodiment falls outside the operation guarantee range. For this reason, whether the supply tube 76 is filled with ink is determined when the signal OutD is low.

The processing flow of detection operation will be explained with reference to FIG. 8.

Figure 8:
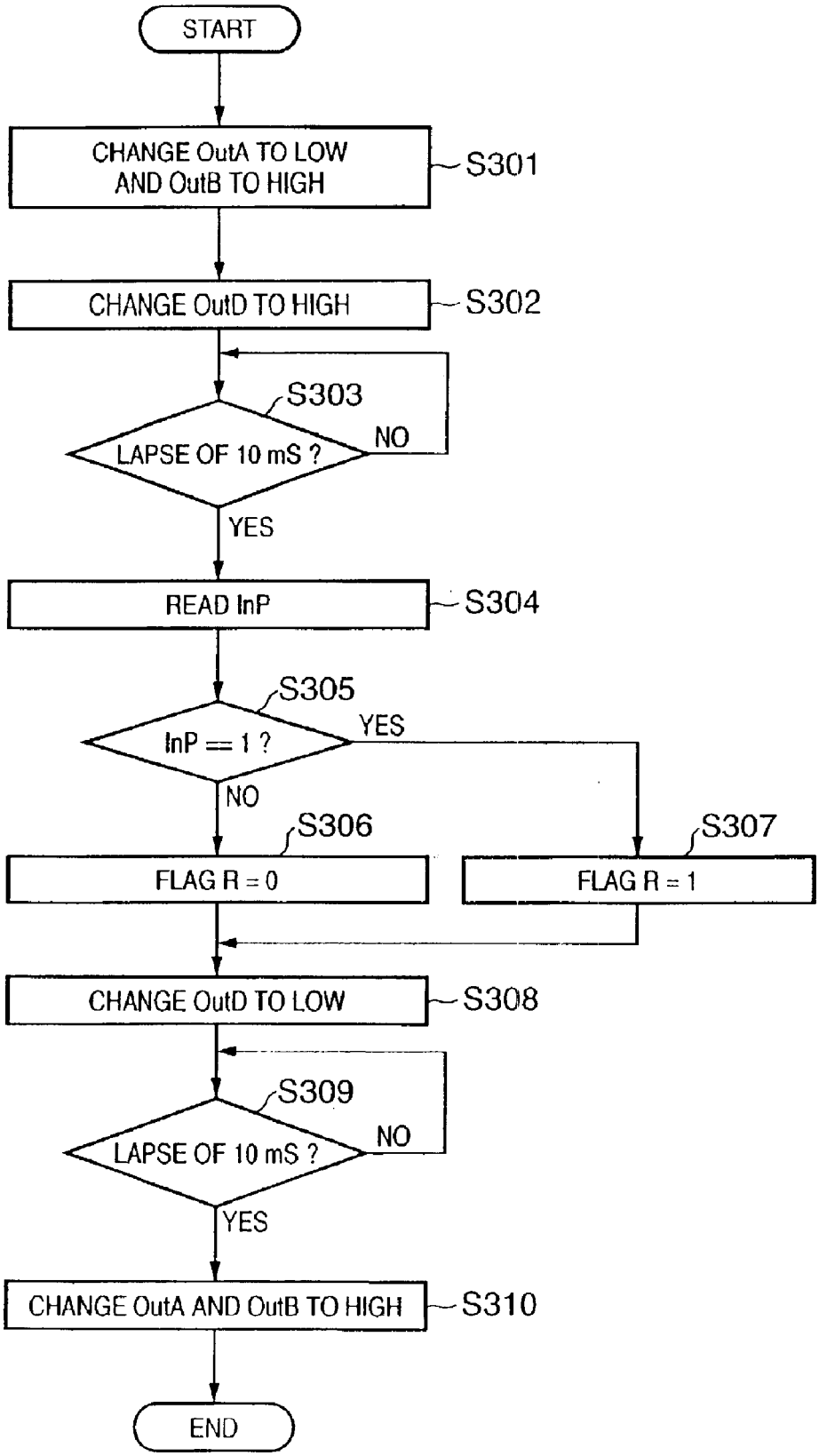
FIG. 8 is a flow chart showing operation of detecting the presence state of ink in a supply tube according to the first embodiment.

FIG. 8 is a flow chart showing operation of detecting the presence state of ink in the supply tube according to the first embodiment.

In step S301, the signals OutA and OutB are changed to low and high, respectively. The reason of changing the signals OutA and OutB to low and high immediately after the start is to connect the terminal X of the analog switch 100 to the terminal X2 and the terminal Y to the terminal Y2.

In step S302, the signal OutD is changed to high.

In step S303, the timer is driven to determine whether a period of 10 ms has been elapsed after the start. If the period of 10 ms has not been elapsed (NO in step S303), the processing waits for the lapse of 10 ms. If the period of 10 ms has been elapsed (YES in step S303), the processing advances to step S304.

In step S304, the value of the signal InP is read. In step S305, whether the value of the signal InP is 1 is determined. If the value is not 1 (NO in step S305), the processing advances to step S306 to determine that the supply tube 76 is not filled with ink and set a flag R representing this to 0. If the value is 1 (YES in step S305), the processing advances to step S307 to determine that the supply tube 76 is filled with ink and set the flag R to 1.

Note that the flag R is stored in, e.g., the RAM 1403.

In step S308, the signal OutD is changed to low. In step S309, the timer is driven to determine whether a period of 10 ms has been elapsed after the signal OutD is changed to low. If the period of 10 ms has not been elapsed (NO in step S309), the processing waits for the lapse of 10 ms. If the period of 10 ms has been elapsed (YES in step S309), the processing advances to step S310.

In step S310, the signals OutA and OutB are changed to high, and the processing ends. The reason of changing the signals OutA and OutB to high immediately before the end of processing is to connect the terminal X of the analog switch 100 to the terminal X3 and the terminal Y to the terminal Y3. That is, the terminals X and Y are disconnected from the hollow needles.

The timer count value of 10 ms in processing of FIG. 8 is larger than the timer count value of 5 ms in processing of FIG. 6 or 7 because the resistance value is high and stabilization of the intermediate potential in the bridge circuit takes a long time due to the stray capacitance or the like.

To reduce the burden on the CPU 1402, the detection time for detecting the ink level is preferably short. The resistance used for detection is not so high in detecting the presence state of ink in the ink tank 501, as shown in FIG. 6, or detecting the ink level in the printhead 401, as shown in FIG. 7. The timer count value for ensuring the resistance value measurement time can therefore be set small. In FIG. 8, however, the count value is set large because of the above reason.

The flag R=1 obtained by the above-described processing represents that ink is filled from the hollow needle 52B of the ink tank 501 to the hollow needle 416A of the printhead 401 via the supply tube 76. The flag R=0 represents that air enters the supply tube 76.

The control program of the printing apparatus 1000 executes processing of FIG. 8 during initial processing executed after power ON of the apparatus, and for the flag R=0, executes ink suction operation described above. When the inkjet printing apparatus has an outer cover and the printing apparatus 1000 comprises a sensor for detecting whether the cover is open or closed, the control program executes processing of FIG. 8 by detecting a change point at which the open cover is closed, and determines the necessity/nonnecessity of ink suction operation.

As described above, according to the first embodiment, the presence state of ink in the ink tank 501, the printhead 401, and the supply tube between the printhead 401 and the ink tank 501 can be detected while an object to be detected is switched. This detection is realized using the hollow needles of the printhead 401 and ink tank 501. Detection concerning ink can be easily executed by a simple arrangement.

(Second Embodiment)

Recent printheads 401 are equipped with a larger number of nozzles, and incorporate a control circuit for controlling the nozzles. To dissipate heat generated by driving the printhead 401, a high-conductivity member is employed. For these reasons, the control circuit often comprises an impurity-doped silicon substrate.

The silicon substrate is in contact with ink in the ink chamber of the printhead 401 directly or via a thin oxide film or the like. The silicon substrate is electrically connected to the ground side or power supply side of the control circuit.

The schematic circuit arrangement of the periphery of the printhead 401 will be described with reference to FIG. 9.

Figure 9:
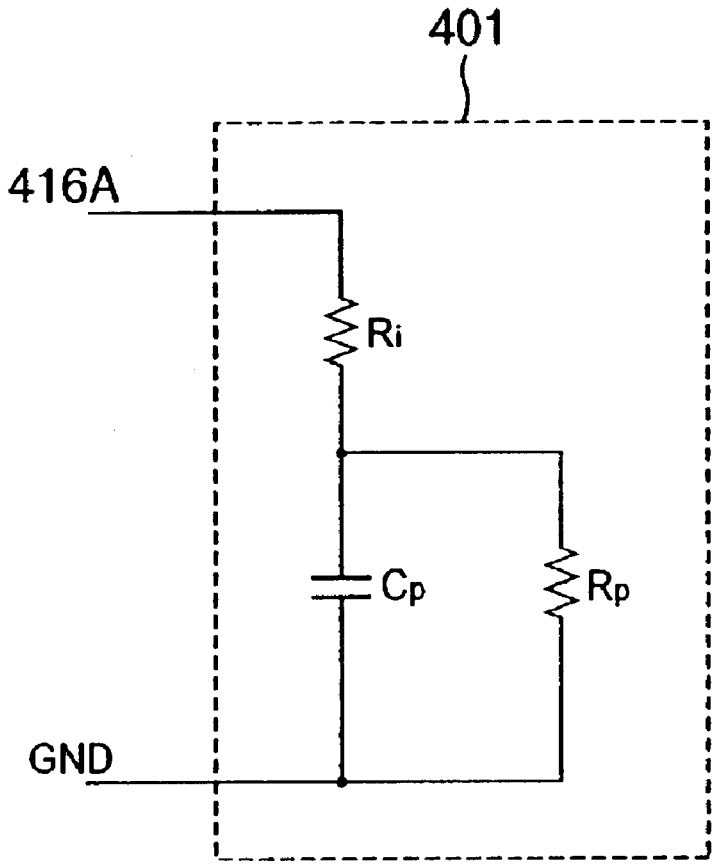
FIG. 9 is a circuit diagram showing an equivalent circuit between a hollow needle and ground of a control circuit according to the second embodiment.

FIG. 9 is a circuit diagram showing an equivalent circuit between a hollow needle 416A and ground of the control circuit according to the second embodiment.

FIG. 9 shows an example in which the silicon substrate is connected to ground of the control circuit. A resistance R1 is an equivalent resistance of ink between the hollow needle 416A and the surface of the silicon substrate. A capacitance Cp is formed by a thin oxide film (insulating film) between the silicon substrate and the ink surface in contact with the silicon substrate.

A resistance Rp is an equivalent resistance of the resistance of a portion where ink is in direct contact with the silicon substrate, and a leakage resistance generated by pinholes of the thin oxide film.

In the printhead 401 used in the second embodiment, the resistance Ri is about 500 kΩ, the capacitance Cp is about 2,000 pF, and the resistance Rp is about 5 MΩ. These values greatly change depending on the difference in ink amount in the printhead 401 or each printhead 401. It is therefore important in terms of the apparatus reliability that the detection function described in the first embodiment is not influenced by the difference.

Detection of the presence state of ink in an ink tank 501 is not influenced by the difference because the ink tank 501 is spaced apart from the printhead 401. Also, detection of the ink level in the printhead 401 is hardly influenced because the resistance when ink reaches a hollow needle 416B is about 20 kΩ and the resistance value is different by one or more orders of magnitude from the resistance Ri of the printhead 401.

To the contrary, in detecting the presence state of ink in a supply tube 76, the resistance value of ink in the supply tube 76 to be detected as described above is as large as 2 MΩ to 3 MΩ.

In the arrangement of the ink detection circuit which is not influenced by the resistance in the control circuit of the printhead 401, the hollow needle 416A (terminal) of the printhead 401 is connected to a low-ground-impedance side in detecting a potential (intermediate potential) at an intermediate position where the voltage is divided by a voltage-dividing resistance (R3 in the second embodiment) series-connected to the resistance value (Rk) of the supply tube 76 to be detected. Ink detection can be executed at a high precision without any influence of the resistance of the printhead 401 or the like.

Figure 10:
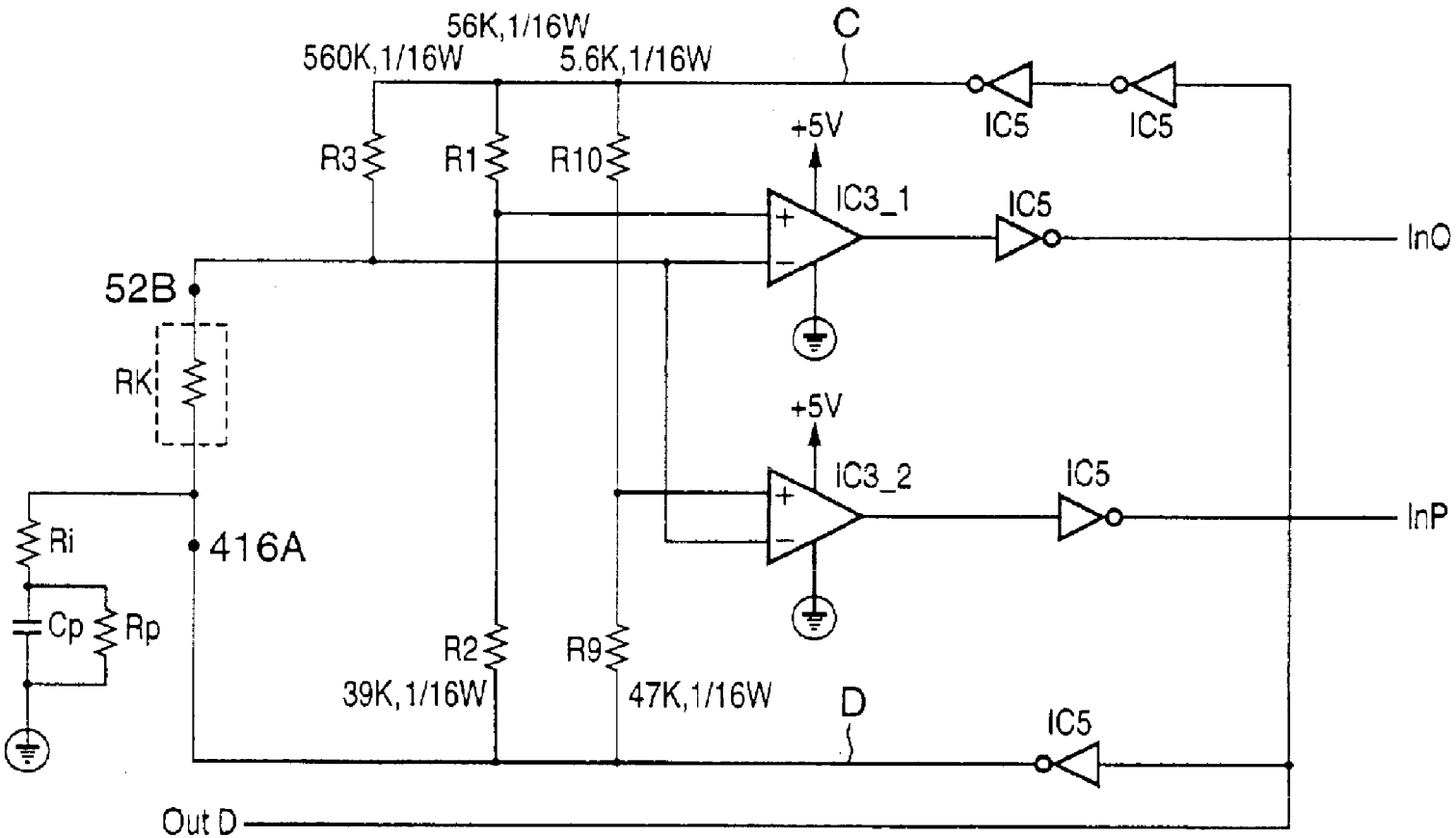
FIG. 10 is a circuit diagram showing the arrangement of the ink detection circuit of an ink supply mechanism according to the second embodiment.

In this case, as shown in FIG. 10, the hollow needle 416A of the printhead 401 is connected to a low-ground-impedance side of the bridge circuit in the ink detection circuit shown in FIG. 5 according to the first embodiment. A hollow needle 52B of the ink tank 501 is connected to the intermediate point of the bridge circuit. FIG. 10 shows the bridge circuit which includes the resistance Ri, capacitance Cp, and resistance Rp in the control circuit of the printhead 401. The resistance Rk in FIG. 10 is a resistance to be measured between the hollow needles 52B and 416A. As is apparent from FIG. 10, the bridge intermediate potential is not influenced by the resistance Ri, capacitance Cp, and resistance Rp, and a high-reliability detection result can be obtained.

Note that the low-ground-impedance side of the bridge circuit is not always the ground side. For a high-level signal OutD in FIG. 10, the potential at point D in FIG. 10 is grounded, and the ground impedance is low. For a low-level signal OutD, the potential at point D serves as the power supply side (5 V). The power supply is equivalently comprised of an electrostatic generator (battery) and an internal resistance. The internal resistance is generally as low as 0.1 Ω or less. That is, the power supply side also provides a low ground impedance.

As described above, according to the second embodiment, the ink detection circuit described in the first embodiment employs the ink detection circuit arrangement as shown in FIG. 10. This allows detecting the presence state of ink at a high precision without any influence of the resistance of the printhead 401 or the like.

(Third Embodiment)

In the first and second embodiments, the bridge circuit is used in the ink detection circuit. The bridge circuit is not necessarily required, and, e.g., an A/D converter can be adopted.

Figure 11:
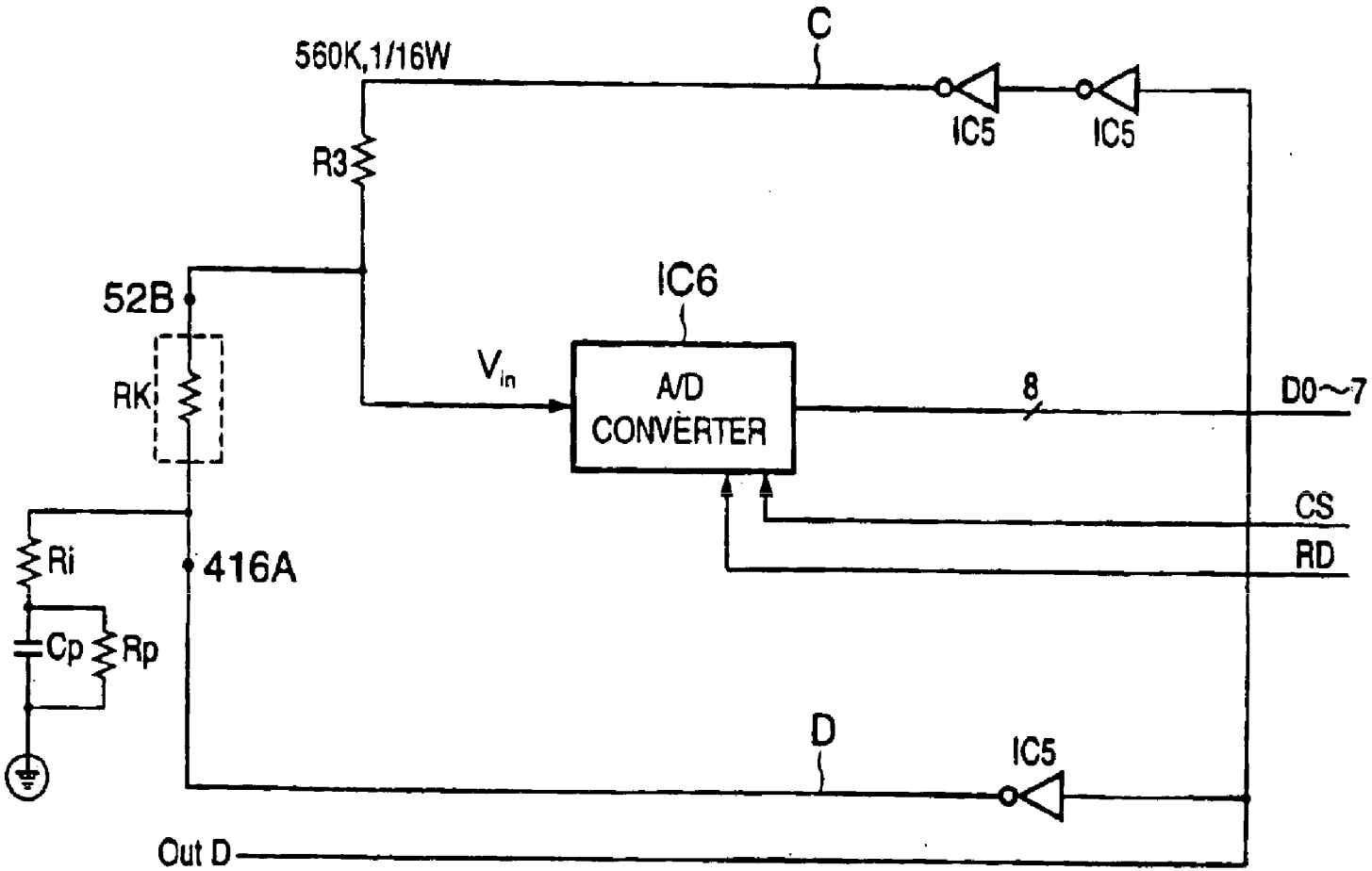
FIG. 11 is a circuit diagram showing the arrangement of the ink detection circuit of an ink supply mechanism according to the third embodiment.

FIG. 11 is a circuit diagram showing the arrangement of the ink detection circuit of an ink supply mechanism according to the third embodiment.

In FIG. 11, reference symbol IC6 denotes an A/D converter. Data busses D0 to D7, chip select CS, and read command RD are connected to a CPU 1402 of a printing apparatus 1000. The CPU 1402 can measure a voltage value Vin at the analog input terminal of the A/D converter IC6. A resistance (resistance between hollow needles 416A and 52B) to be measured and a resistor R3 constitute a bleeder circuit between the power supply and ground.

Similar to the second embodiment, a signal OutD and an inverter IC5 function as a switching means for switching between the power supply and ground at two ends of the bleeder circuit. The analog input terminal of the A/D converter IC6 is connected to the intermediate portion of the bleeder circuit. The intermediate potential changes depending on the resistance value of the resistance (resistance between the hollow needles 416A and 52B) to be measured.

The resistance value of the resistor R3 according to the third embodiment is 560 kΩ. The resistance value when ink exists between the hollow needles 416A and 52B is 2 MΩ to 3 MΩ, similar to the first and second embodiments. To detect the presence state of ink for a high-level signal OutD and set the detection threshold to 5 MΩ, the voltage value Vin is given by $$Vin=5\ V\times 5\ M\Omega/(390\ k\Omega+5\ M\Omega)$$

More specifically, the voltage value Vin is about 4.64 V. The CPU 1402 reads the value of the A/D converter IC6 for a high-level signal OutD. When the voltage value Vin is less than 4.64 V, ink is determined to be filled from the hollow needle 52B of the ink tank 501 to the hollow needle 416A of the printhead 401 via a supply tube 76. When the value Vin is 4.64 V or more, air is determined to enter the supply tube 76.

As described above, the third embodiment employs the A/D converter instead of the bridge circuit in the ink detection circuit described in the first and second embodiments. The third embodiment can further simplify the circuit arrangement.

In the first to third embodiments, the hollow needle serving as a communication member for making ink and gas flow also functions as a detection terminal for detecting the ink level. Alternatively, a detection terminal may be arranged in addition to the hollow needle.

However, the use of the communication member as a detection terminal can desirably simplify a structure of preventing leakage of ink from the printhead 401 and ink tank 501. The number of detection terminals is not limited to two at each detection portion, and can be arbitrarily set as far as detection terminals can detect the presence state of ink at each detection portion.

The above embodiments have been explained by assuming that a droplet discharged from a printhead is ink and a liquid contained in an ink tank is ink. However, the content of the ink tank is not limited to ink. For example, the ink tank may contain a processing solution to be discharged onto a printing medium to increase the fixing properties, water resistance, or quality of a printed image.

The above embodiments can increase the density and resolution of printing by using a system which includes a means (e.g., an electrothermal transducer or laser beam) for generating heat energy as energy used to discharge ink and causes a state change of the ink by this heat energy, among other inkjet printing systems. The printhead is not limited to this system, and may discharge ink by using a piezoelectric element.

As a representative arrangement or principle, it is preferable to use the basic principle disclosed in, e.g., U.S. Pat. No. 4,723,129 or U.S. Pat. No. 4,740,796. This system is applicable to both a so-called on-demand apparatus and continuous apparatus. The system is particularly effective in an on-demand apparatus because at least one driving signal which corresponds to printing information and gives a rapid temperature rise exceeding nuclear boiling is applied to an electrothermal transducer which corresponds to a sheet or channel holding a liquid (ink), thereby causing this electrothermal transducer to generate heat energy and cause film boiling on the thermal action surface of a printhead, and consequently a bubble can be formed in the liquid (ink) in one-to-one correspondence with the driving signal.

By growth and shrinkage of this bubble, the liquid (ink) is discharged from an orifice to form at least one droplet. This driving signal is more preferably a pulse signal because growth and shrinkage of a bubble are instantaneously appropriately performed, so discharge of the liquid (ink) having high response is achieved.

This pulse driving signal is preferably a signal described in U.S. Pat. No. 4,463,359 or U.S. Pat. No. 4,345,262. Note that superior printing can be performed by the use of conditions described in U.S. Pat. No. 4,313,124 which is the invention concerning the rate of temperature rise on the thermal action surface.

The arrangement of a printhead can be a combination (a linear liquid channel or a right-angle liquid channel) of orifices, liquid channels, and electrothermal transducers disclosed in the specifications described above. The present invention also includes arrangements using U.S. Pat. Nos. 4,558,333 and 4,459,600 in each of which the thermal action surface is placed in a bent region.

Furthermore, a full line type printhead having a length corresponding to the width of the largest printing medium printable by a printing apparatus can have a structure which meets this length by combining a plurality of printheads as disclosed in the aforementioned specifications or can be a single integrated printhead.

In addition, it is possible to use not only a cartridge type printhead, explained in the above embodiments, in which ink tanks are integrated with a printhead itself, but also an interchangeable chip type printhead which can be electrically connected to an apparatus main body and supplied with ink from the apparatus main body when attached to the apparatus main body.

Adding a recovering means or a preliminary means for a printhead to the printing apparatus described above is preferable because printing operation can further stabilize. Practical examples of the additional means for a printhead are a capping means, a cleaning means, a pressurizing or drawing means, and an electrothermal transducer or another heating element or a preliminary heating means combining them. A predischarge mode for performing discharge different from printing is also effective to perform stable printing.

A printing mode of the printing apparatus is not restricted to a printing mode using only a main color such as black. That is, the apparatus can have at least a composite color mode using different colors and a full color mode using mixed colors, regardless of whether a printhead is an integrated head or a combination of a plurality of heads.

The present invention is also achieved by supplying a software program (in the above embodiments, programs corresponding to flow charts shown in the accompanying drawings) for realizing the functions of the above-described embodiments to a system or apparatus directly or from a remote place, and reading out and executing the supplied program codes by the computer of the system or apparatus. In this case, the software need not be a program as far as it has a program function.

The present invention is therefore realized by program codes installed into the computer in order to realize functional processing of the present invention. That is, the present invention includes a computer program for realizing functional processing of the present invention.

In this case, the present invention can take any program form such as an object code, a program executed by an interpreter, or script data supplied to an OS as long as a program function is attained.

A recording medium for supplying the program includes a floppy disk, hard disk, optical disk, magnetooptical disk, MO, CD-ROM, CD-R, CD-RW, magnetic tape, nonvolatile memory card, ROM, and DVD (DVD-ROM and DVD-R).

As another program supply method, the program can be supplied by connecting a client computer to an Internet homepage via the browser of the client computer, and downloading the computer program of the present invention or a compressed file containing an automatic installing function from the homepage to a recording medium such as a hard disk. The program can also be supplied by classifying program codes which constitute the program of the present invention into a plurality of files, and downloading the files from different homepages. That is, the present invention also contains a WWW server which allows a plurality of uses to download the program files for realizing functional processing of the present invention by a computer.

The present invention can also be realized by the following method. That is, the program of the present invention is encrypted, stored in a storage medium such as a CD-ROM, and distributed to the user. A user who satisfies predetermined conditions is caused to download decryption key information from a homepage via the Internet. The user executes the encrypted program by using the key information, and installs the program in the computer.

The functions of the above-described embodiments are realized when the computer executes a readout program. Also, the functions of the above-described embodiments are realized when an OS or the like running on a computer performs part or all of actual processing on the basis of the instructions of the program codes.

The functions of the above-described embodiments are also realized when a program read out from a storage medium is written in the memory of a function expansion board inserted into a computer or the memory of a function expansion unit connected to the computer, and the CPU of the function expansion board or function expansion unit performs part or all of actual processing on the basis of the instructions of the program codes.

As many apparently widely different embodiments of the present invention can be made without departing from the spirit and scope thereof, it is to be understood that the invention is not limited to the specific embodiments thereof except as defined in the appended claims.

What is claimed is:

1. An inkjet printing apparatus which holds a printhead for performing printing by using ink supplied from an ink tank via an ink supply channel, comprising:

the ink tank has a tank-side terminal for detecting presence state of ink in the ink tank, the printhead has a head-side terminal for detecting the presence state of ink in the printhead, and the printing apparatus comprises detection means for detecting at least one of the presence state of ink in the ink tank, the printhead, and the ink supply channel by selecting a terminal used for detection between the tank-side terminal and the head-side terminal, wherein said detection means detects the presence state of ink in any combination between the ink tank, the printhead, and the ink supply channel by switching a terminal to be selected.

2. The apparatus according to claim 1, wherein a detection time for detecting the presence state of ink in the ink supply channel is set longer than a detection time for detecting the presence state of ink in the ink tank and the printhead.

3. The apparatus according to claim 1, wherein the ink tank has at least two, first and second tank-side terminals, the printhead has at least two, first and second head-side terminals, the first tank-side terminal functions as an air communication terminal, the ink supply channel is connected between the second tank-side terminal and the second head-side terminal, and said detection means switches and executes detection of the presence state of ink in the ink tank by using the first and second tank-side terminals, detection of the presence state of ink in the printhead by using the first and second head-side terminals, and detection of the presence state of ink in the ink supply channel by using the second tank-side terminal and the second head-side terminal.

4. The apparatus according to claim 3, wherein said detection means comprises voltage application means for applying voltages between the first and second tank-side terminals, between the first and second head-side terminals, and between the second tank-side terminal and the second head-side terminal, current detection means for detecting currents flowing between the first and second tank-side terminals, between the first and second head-side terminals, and between the second tank-side terminal and the second head-side terminal, and switching means for switching voltage directions between the first and second tank-side terminals, between the first and second head-side terminals, and between the second tank-side terminal and the second head-side terminal.

5. The apparatus according to claim 4, wherein said detection means executes switching operation by said switching means every predetermined period.

6. The apparatus according to claim 1, wherein a detection time from switching a terminal to starting a detection for detecting the presence state of ink in the ink supply channel is set longer than a time from switching a terminal to starting a detection for detecting the presence state of ink in the ink tank and the printhead.

7. An inkjet printing apparatus which holds a printhead for performing printing by using ink supplied from an ink tank via an ink supply channel, comprising:

current supply means for supplying a current to the ink supply channel by using a terminal attached to the printhead; and a detection circuit which detects presence state of ink in the ink supply channel by detecting an intermediate potential between a resistance concerning a state of ink in the ink supply channel and a voltage-dividing resistance series-connected to the resistance, wherein the terminal attached to the printhead is electrically connected to a low-ground-impedance side of said detection circuit.

8. The apparatus according to claim 7, wherein the terminal also serves as a communication member for making ink and air flow.

9. A method of controlling an inkjet printing apparatus which holds a printhead for performing printing by using ink supplied from an ink tank via an ink supply channel, comprising:

a detection step of detecting at least one of presence state of ink in the ink tank, the printhead, and the ink supply channel by selecting a terminal used for detection between terminals which are attached to the ink tank and the printhead and detect the presence state of ink in the ink tank and the printhead; and a control step of controlling detection in the detection step.

10. The method according to claim 9, wherein said detection step detects the presence state of ink in any combination between the ink tank, the printhead, and the ink supply channel by switching a terminal to be selected.

11. The method according to claim 10, wherein in the control step, a detection time for detecting the presence state of ink in the ink supply channel in the detection step is set longer than a detection time for detecting the presence state of ink in the ink tank and the printhead.

12. The method according to claim 10, wherein the ink tank has at least two, first and second tank-side terminals, the printhead has at least two, first and second head-side terminals, the first tank-side terminal functions as an air communication terminal, the ink supply channel is connected between the second tank-side terminal and the second head-side terminal, and in the control step, detection of the presence state of ink in the ink tank by using the first and second tank-side terminals in the detection step, detection of the presence state of ink in the printhead by using the first and second head-side terminals, and detection of the presence state of ink in the ink supply channel by using the second tank-side terminal and the second head-side terminal are switched and executed.

13. The method according to claim 12, wherein the detection step comprises a voltage application step of applying voltages between the first and second tank-side terminals, between the first and second head-side terminals, and between the second tank-side terminal and the second head-side terminal, a current detection step of detecting currents flowing between the first and second tank-side terminals, between the first and second head-side terminals, and between the second tank-side terminal and the second head-side terminal, and a switching step of switching voltage directions between the first and second tank-side terminals, between the first and second head-side terminals, and between the second tank-side terminal and the second head-side terminal.

14. The method according to claim 13, wherein in the detection step, switching operation in the switching step is executed every predetermined period.

15. The method according to claim 13, wherein the terminal also serves as a communication member for making ink and air flow.

16. The method according to claim 9, wherein the terminal also serves as a communication member for making ink and air flow.

17. A method of controlling an inkjet printing apparatus which holds a printhead for performing printing by using ink supplied from an ink tank via an ink supply channel, comprising:

a current supply step of supplying a current to the ink supply channel by using a terminal attached to the printhead; and a control step of controlling a detection circuit which detects presence state of ink in the ink supply channel by detecting an intermediate potential between a resistance concerning a state of ink in the ink supply channel and a voltage-dividing resistance series-connected to the resistance, wherein the terminal attached to the printhead is electrically connected to a low-ground-impedance side of the detection circuit.

* * * * *